US008757922B1

(12) United States Patent
Ciccarello

(10) Patent No.: US 8,757,922 B1
(45) Date of Patent: Jun. 24, 2014

(54) INTERENGAGEABLE PAVING STONE

(71) Applicant: Techo-Bloc Inc., St-Hubert (CA)

(72) Inventor: Charles Ciccarello, St-Jean-sur-Richelieu (CA)

(73) Assignee: Techo-Bloc inc., St-Hubert, Quebec ( * ) Notice: Subject to any disclaimer, the term of this patent is extended or adjusted under 35 U.S.C. 154(b) by 0 days.

(21) Appl. No.: 13/904,670

(22) Filed: May 29, 2013

(30) Foreign Application Priority Data

Feb. 21, 2013 (CA) ..... 2807160

(51) Int. Cl.
*E01C 5/06* (2006.01)
*E04B 5/08* (2006.01)

(52) U.S. Cl.
USPC ..... 404/38; 404/37; 404/41; 52/603; 52/605

(58) Field of Classification Search
USPC ..... 404/34, 37, 38, 40, 41; 52/596, 603, 52/604, 605; D25/113
See application file for complete search history.

(56) References Cited

U.S. PATENT DOCUMENTS

| | | | | | |
|---|---|---|---|---|---|
| 31,093 | A * | 1/1861 | Smith | 404/41 |
| 1,045,328 | A * | 11/1912 | Sammis | 404/41 |
| 1,096,267 | A * | 5/1914 | Sammis | 404/38 |
| 1,186,673 | A * | 6/1916 | Mallet | 52/592.1 |
| D58,660 | S * | 8/1921 | Clouser et al. | D25/113 |
| 1,670,678 | A * | 5/1928 | Cowper | 404/32 |
| 1,981,324 | A * | 11/1934 | Peterson | 52/591.2 |
| 6,988,847 | B2 * | 1/2006 | Lazar | 404/39 |
| 7,162,838 | B2 * | 1/2007 | Ardern | 52/127.9 |
| D688,811 | S * | 8/2013 | Ciccarello | D25/113 |
| 8,601,758 | B2 * | 12/2013 | Biadora | 52/223.7 |

* cited by examiner

*Primary Examiner* — Gary Hartmann
(74) *Attorney, Agent, or Firm* — Norton Rose Fulbright Canada LLP

(57) ABSTRACT

A concrete casted paving stone of rectangular shape is described and has two pairs of opposed parallel side walls. In a first of the two pairs of side walls, an engaging projection is formed in one side wall and a through slot in the other side wall for receiving the stone-engaging projection of another paving stone therein. The second pair of opposed parallel side walls each have a slot and a further stone-engaging projection in a section thereof. The stone-engaging projections of the second pair of side walls are disposed adjacent the side wall of the first pair which contains the slot and the slot extends through the rear wall of these stone-engaging projections. The paving stone may be used as a permeable paving stone wherein to evacuate water from an upper surface of a paved surface into the underlying support bed.

19 Claims, 5 Drawing Sheets

INTERENGAGEABLE PAVING STONE

TECHNICAL FIELD

The present invention relates to a precast concrete paving stone which is interengageable-like stones on all side walls thereof to form a paved surface.

BACKGROUND ART

When constructing paving surfaces with paving stones, it is desirable that the stones be interengaged whereby to provide a better distribution of loading in the horizontal surface of the paved surface. This substantially reduces the formation of undulations and the dislodging of stones within the paved surface. In some applications, it is also desirable that these paved surfaces be permeable whereby to prevent the collection of water thereon. For such an application it is necessary that the stones have a spacing thereabout and with the spacing providing orifices for water to seep to the support bed of the paving stones.

Another advantage of interengageable paving stones is that in the event that the support bed heaves due to frost penetrating therein causing the support bed to expand, a group of paving stones will heave in interengagement due to its monolithic structure and then resettle once the frost disappears while maintaining their interengagement.

A problem with the construction of paving stones with stone interengaging features is that they are difficult to mold due to the fact that there are stone-engaging projections and slots in at least some of the side walls of the stone. Such molding process is costly, slow and results in mechanical breakdowns of the molding equipment causing the production thereof to shut down and thus resulting in extra costs.

Because these molds are complex, there are often cavities within the molds which are not fully filled with concrete and particularly under the stone-engaging projections. Also, the mold walls are hydraulically open in sequence. Any malformation in the projections or slot results in waste product and still further adding to cost.

SUMMARY OF INVENTION

It is a feature of the present invention to provide a concrete casted paving stone which substantially overcomes the above-mentioned disadvantages of the prior art.

Another feature of the present invention is to provide a concrete casted paving stone having two pairs of opposed side walls one of these pairs having a slot and a projection in each of the side walls and the other pair of parallel side walls having a projection in one wall and a slot in the other wall.

Another feature of the present invention is to provide a concrete casted paving stone which has projections and slots and which is engageable on all side walls of the stone by like stones to form a paved surface.

Another feature of the present invention is to provide a concrete casted paving stone which is easy to manufacture and which is casted upright thus eliminating the above-mentioned casting problems of the prior art.

Another feature of the present invention is to provide a concrete casted paving stone which is interengageable with other like stones and which may be used to construct a permeable paving surface.

Another feature of the present invention is to provide a concrete casted paving stone which is of rectangular shape and engageable on all side walls thereof and which can be used to create paved surfaces constituted by parallel rows of paving stones or an offset layout of paving stones.

Another feature of the present invention is to provide a concrete casted paving stone which is interengageable with like paving stones to form a paved surface and wherein rain water or water from melting snow can percolate through open-joints filled with a grout between the paving stones to form a permeable paved surface.

Another feature of the present invention is to provide an interengageable concrete casted paving stone which is easy to assemble with like paving stones to form a monolithic paved surface.

Another feature of the present invention is to provide a concrete casted paving stone which is provided with three stone engaging projections and slots for interconnection therewith and which is molded vertically to prevent any malformation in the concrete casted paving stone.

According to the above features, from a broad aspect, the present invention provides a concrete casted paving stone having opposed top and bottom surfaces and two pairs of opposed parallel side walls. A first pair of the side walls has a stone-engaging projection of predetermined shape formed in one of the side walls and spaced between the top and bottom surfaces. The other of the side walls has a slot shaped to receive therein at least a forward end portion of the stone-engaging projection of an adjacent one of the paving stones for interengagement therewith. A second of the pairs of opposed parallel side walls each have an elongated horizontal slot and a further stone-engaging projection horizontally aligned with the elongated horizontal slot wherein to engage with a further adjacent one of the paving stones with at least a forward end portion of the further stone engaging projection engaged in the elongated slot of a further adjacent one of the paving stone whereby a plurality of these paving stones can be interengaged to form a paved surface.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
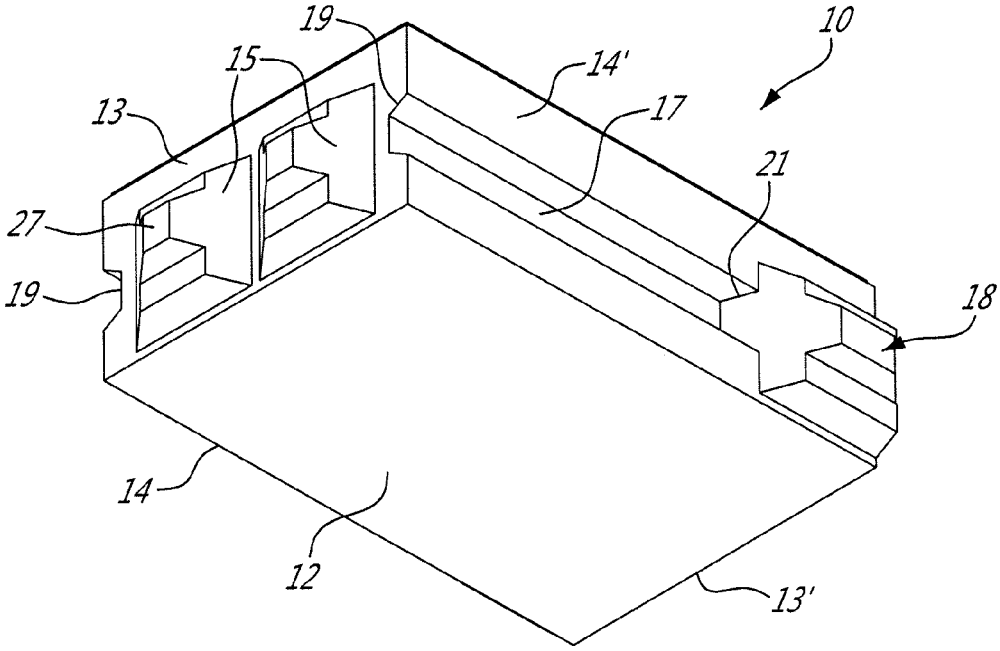
FIG. 1 is a perspective view of the concrete casted interengageable paving stone of the present invention as seen from underneath.
Figure 2:
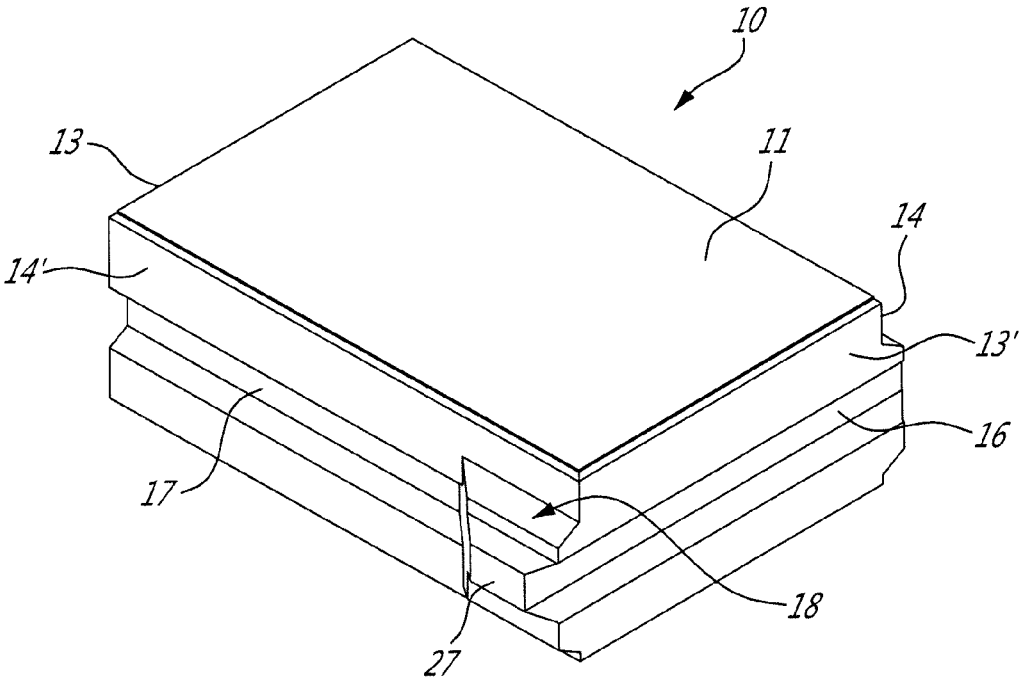
FIG. 2 is a further perspective view of the concrete casted interengageable paving stone as viewed from the top and rear end thereof.

Referring now to the drawings and more particularly to FIGS. 1 to 4, there is shown generally at 10 the concrete casted interengageable paving stone of the present invention. The paving stone 10 has opposed top and bottom surfaces, namely top surface 11 and bottom surface 12. It also has two pairs of opposed parallel side walls, a first pair constituted by side walls 13 and 13' and a second pair constituted by side walls 14 and 14'. The side wall 13 of the first pair of side walls has a stone-engaging projection 15, herein two projections 15 and 15' positioned in aligned side-by-side spaced relationship. These stone engaging projections have a predetermined shape as will be described later and adapted to be engaged in a slot 16 which is shaped to receive at least a forward end portion, herein forward end portion 15' of the projections 15 of an adjacent paving stone 10 for interengagement therewith.

Figure 7:
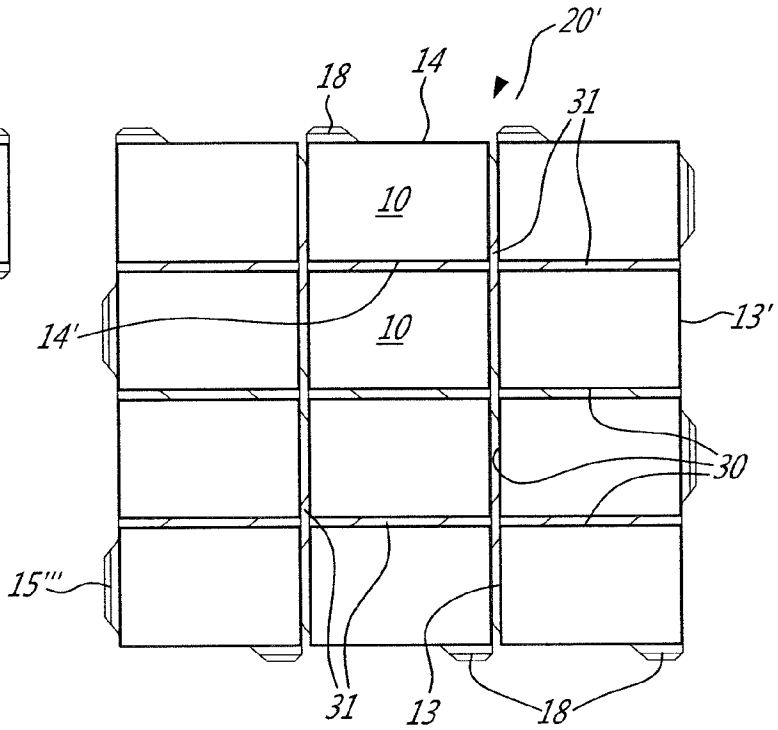
FIG. 7 is a top view showing the interengageable paving stone interengaged with one another in parallel rows.
Figure 6:
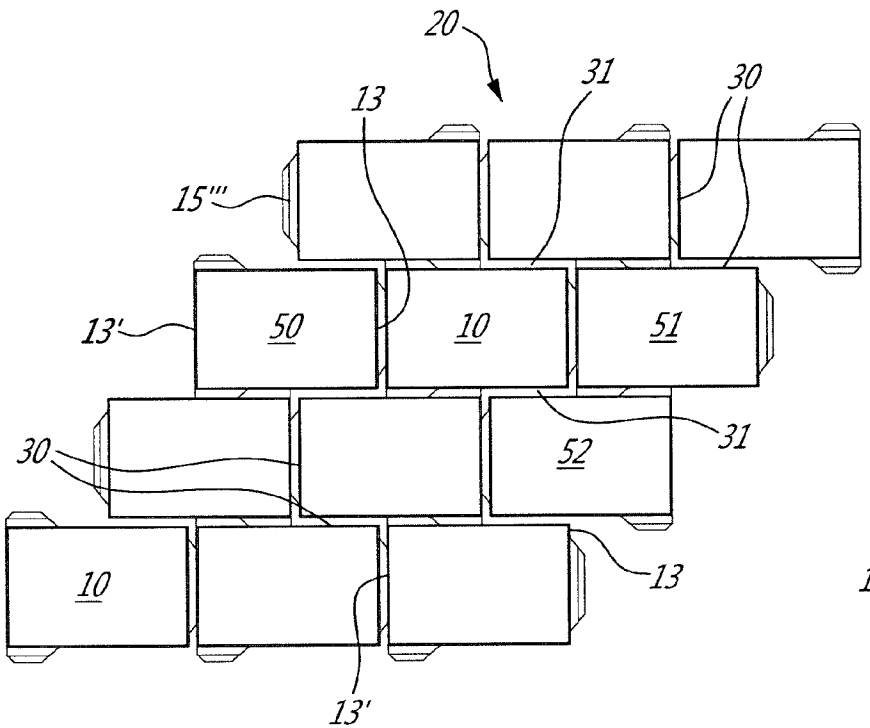
FIG. 6 is a top view showing a plurality of the interengageable paving stones interengaged with one another in an offset parallel row configuration.

The second pair of opposed parallel side walls, namely side was 14 and 14', are likely formed. Each of these side walls 14 and 14' has an elongated horizontal slot 17 and a further stone-engaging projection 18 horizontally aligned with the elongated slot 17 wherein to engage with a further adjacent one of the paving stones 10 with at least a forward end portion of the further paving stone engaging projection 18 engaged in the elongated slot 17 of an adjacent stone 10 whereby a plurality of these paving stones can be interengaged to form a paved surface such as the paved surfaces 20 and 20' as illustrated in FIGS. 6 and 7.

Figure 4:
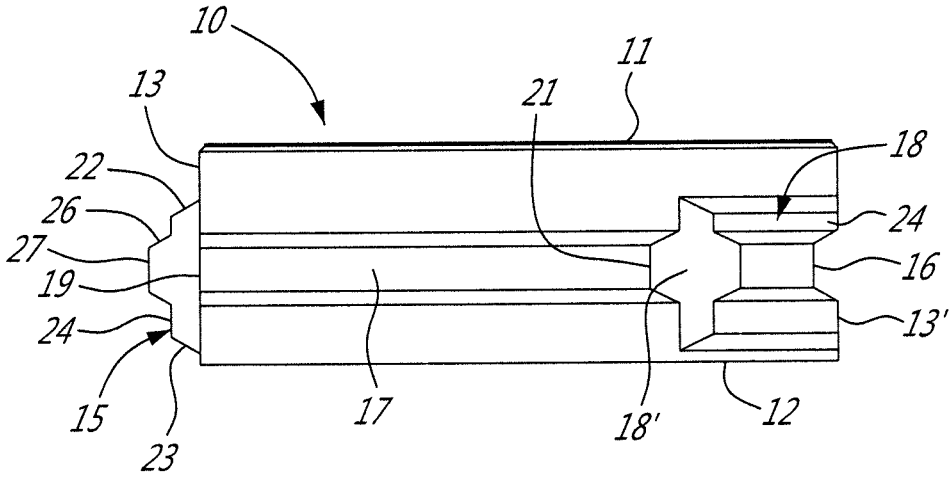
FIG. 4 is a side view of the concrete casted interengageable paving stone.

As better illustrated in FIG. 4, the elongated slot 17 in the second pair of side walls 14 and 14' extends from an open end 19 located at the side wall 13 of the first pair of side walls where the interengaged projections 15 are located and terminate at an opposed end 21 which is beyond midlength of the side surfaces 14 and 14'. The further stone-engaging projections 18 extend from this opposed end 21 of the horizontal slot 17 to the side wall 13' of the first pair of side walls. As can be seen from FIGS. 2 and 4, the slot 16 in the side wall 13' is a through slot which extends to the pair of side walls 14' and through a rear wall of the stone-engaging projections 18. The front wall 18' of the stone-engaging projections 18 is also sloped rearwardly outwards.

Each of the stone-engaging projections 15 and 18 are likely shaped and they have a base portion 15" formed by opposed top and bottom inwardly sloping projecting walls 22 and 23 spaced from the top and bottom surfaces 11 and 12 respectively and terminate at a flat ridge 24 disposed parallel to the side wall 13. These stone-engaging projections 15 and 18 are of pyramid outline and have sloped side was and further have a second portion or end portion 15' which extends from this flat ridge 24 and shaped for close fit engagement in at least a portion of the elongated shaped horizontal slot 16 of the further adjacent side wall 13'. These opposed top and bottom projecting walls 22 and 23 as well as the opposed walls 25 and 26 of the end portion 15' are inwardly sloping flat walls each terminating in flat surfaces of the ridge 24 or the outer end 27 of the end portion 15'. Accordingly, when the stones are interengaged to form a paving surface, as shown in FIGS. 5, 6 and 7, only the end portion 15' of these stone-engaging projections 15 and 18 will engage within respective slots 16 and 17 of adjacent stones and form open joints 30 between the paving stones 10.

Figure 5:
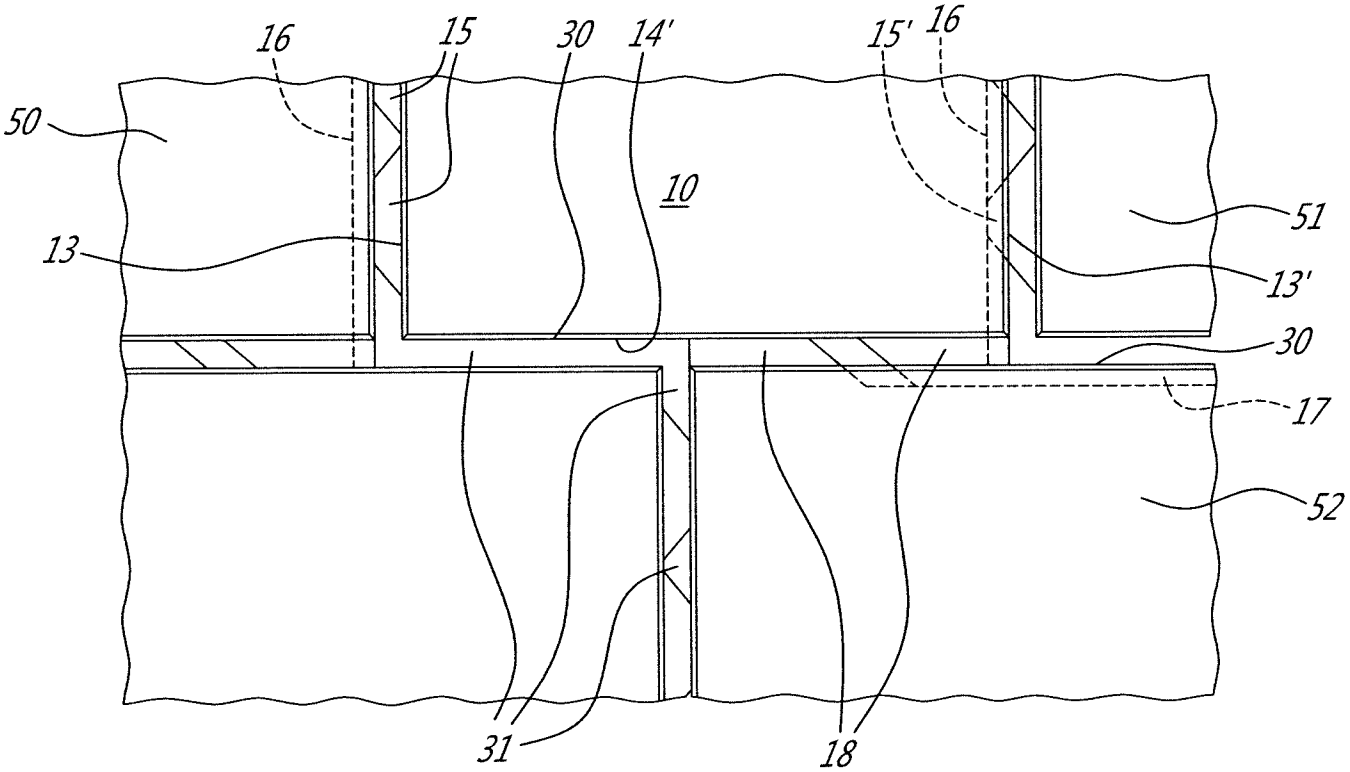
FIG. 5 is an enlarged fragmented top view showing a plurality of the interengageable paving stones interengaged with one another and which form through open joint areas between the stones for the evacuation of water.

As shown in the fragmented view in FIG. 5, it can be seen, for example, that stone 10 has its projection 15 engaged with the slot 16, hereinshown in phantom lines, of an adjacent paving stone 50. Its opposed parallel surface 13' receives the forward end portion 15' of paving stone 51 in its through slot 16, also shown in phantom line and with the forward end portion 15' also shown in phantom line. Accordingly, paving stone 10 is secured in its first pair of opposed side walls with adjacent paving stones 50 and 51. Similarly, the opposed side walls 14 and 14' of the second pair of side walls have its stone engaging projection 18 engaged within the slot 17, shown in phantom lines, of an adjacent stone 52, hereinshown with paving stones 10 disposed in an offset paving pattern, as illustrated in FIG. 6. The adjacent stone 52 also has its stone engaging projection 18 engaged in the elongated horizontal slot 17 of stone 10 and this configuration is also the same on the other side wall 14, not shown. Accordingly, paving stone 10 and all other paving stones that are surrounded by paving stones are engaged on all side walls thereof to create a monolithic structure for the distribution of loading forces in surrounding paving stones.

As can also be seen from FIG. 5, uninterrupted open areas 31 are formed in the open joints 30 where there are no stone-engaging projections. All of the open joints between the stones are, of course, filled with sand or other aggregate filling material and the uninterrupted open areas provide seepage zones for water to percolate therethrough from the top of a paved surface to the underlying support bed whereby water is quickly evacuated.

As can be better seen from FIG. 4, the stone-engaging projections 15 and the slot 16 of the first pair of opposed parallel side walls and the elongated slot 17 and stone-engaging projection 18 of the second pair of opposed parallel side walls lie in a common plane spaced between the top and bottom surfaces 11 and 12 of the paving stone 10. Also, the ridges 24 of each of the stone engaging projections form a flat abutment surface against the parallel side walls adjacent paving stones.

Figure 3:
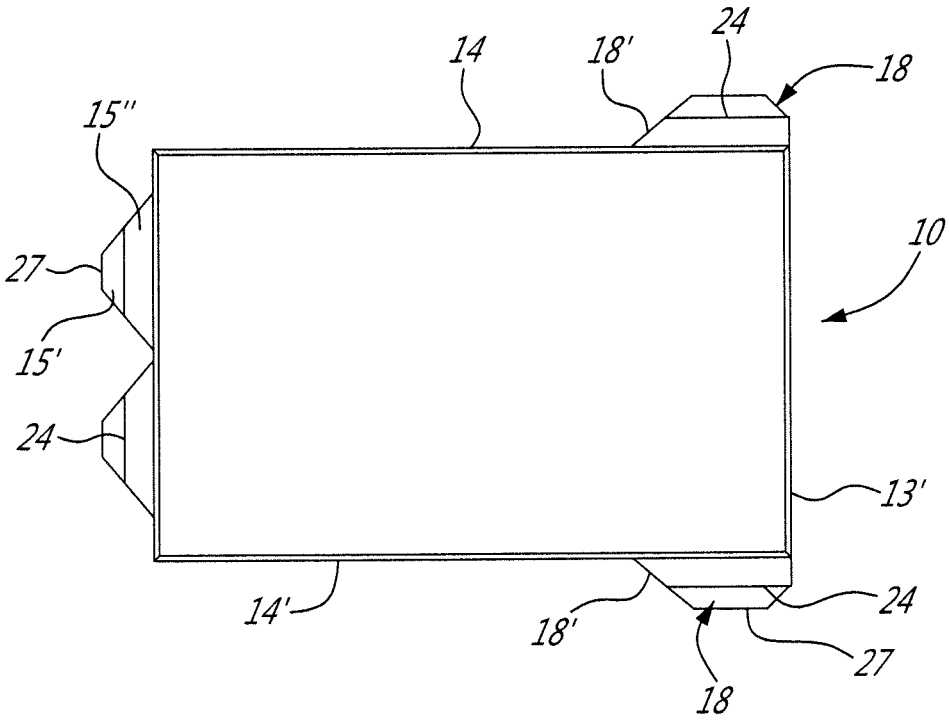
FIG. 3 is a top view of the concrete casted interengageable paving stone.

In FIG. 3 there is illustrated two stone-engaging projections 15 in the side wall 13 whereas in FIGS. 6 and 7 there is only a single elongated stone-engaging projection 15''' projecting from the surface 13 of the stone 10 and having elongated ridges to abut against an adjacent paving stone, it is also pointed out, with reference to FIG. 5, that the void ratio or interrupted open area to the top surface of the paving stone 10 is about 6% of the paving stone top surface.

FIGS. 5 and 6 illustrate a paved surface 20 constituted by the paving stones 10 being disposed and interengaged in an offset relationship wherein the joints are offset substantially at the mid-length of adjacent paving stones. FIG. 7 shows a paved pattern wherein all of the stones are lined up in parallel horizontal and vertical rows. As shown in these Figures, the paving stones are laid in horizontal rows with the paving stones of adjacent rows disposed in alternating directions, that is to say the stone engaging projections 15''' of one row facing in one direction and those of the adjacent row facing in the opposite direct.

Figure 8B:
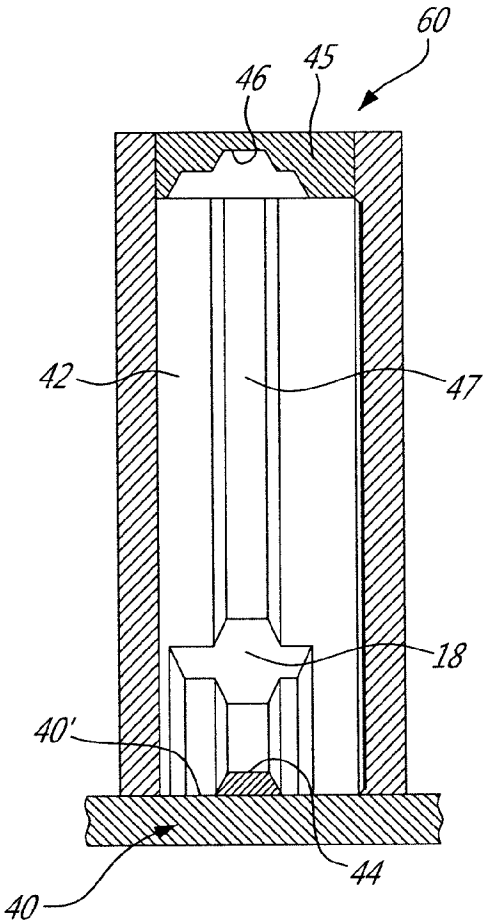
FIG. 8B is an end view of the mold.
Figure 8A:
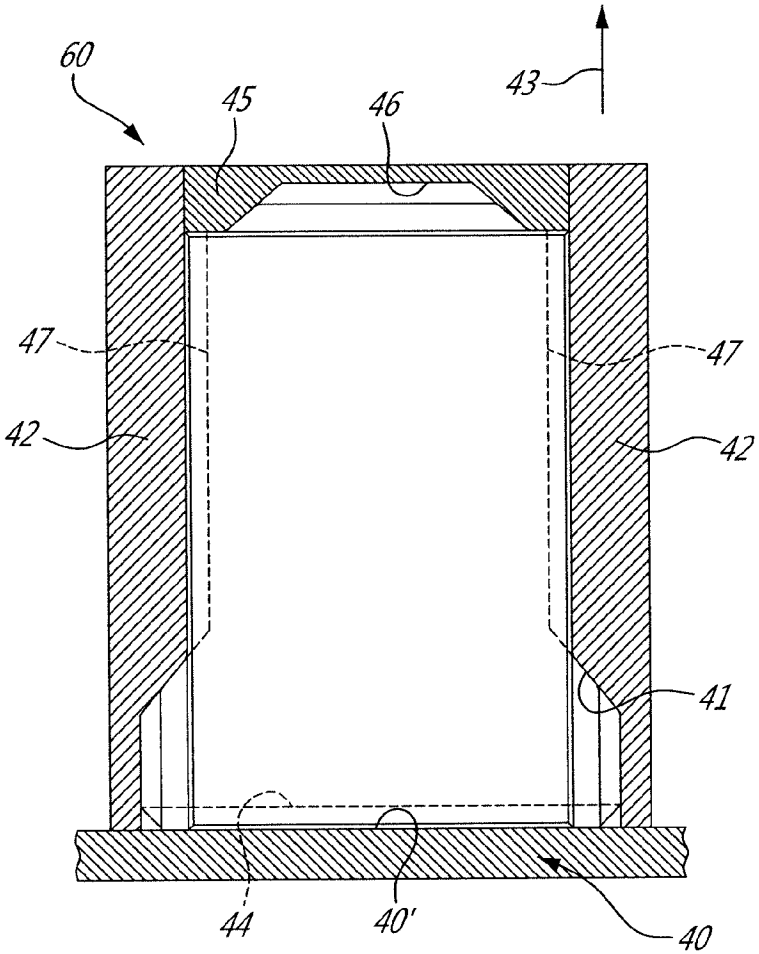
FIG. 8A is a simplified section view showing the construction of a mold for vertically molding the concrete casted interengageable paving stone of the present invention.

As above-mentioned, these interengageable paving stones are casted upright in a mold such as schematically illustrated in FIGS. 8A and 8B. The mold 60 is constituted by a carrier plate 40 with the stone engaging projections of the side walls 14 and 14' of the paving stone 10 being formed by wall cavities 41 of the mold side plates 42. Also, the stone-engaging projections 18 have a rearwardly sloped front face 18' to facilitate the distribution of concrete into the mold cavities 41 and to facilitate extraction of the mold in an upright direction as indicated by arrow 43. As hereinshown, the further stone engaging projections 18 are formed resting on the top surface 40' of the carrier plate 40. The carrier plate also has a slot forming ridge 44 on the top surface 40' thereof to form the through slot 16 in the casted stone.

The top plate 45 of the mold also has a single or two cavities 46 therein, herein a single, to form the single stone-engaging projection 15''' as shown in FIG. 6 or two cavities to form the stone-engaging projections 15 as shown in FIG. 3. The side plates 42 of the mold further have elongated ridges 47 to form the elongated horizontal slot 17 and the further stone-engaging projection 18 as shown in FIGS. 8A and 8B. This mold is filled with concrete and vibrated in the usual manner of casting paving stones and the mold is extracted vertically leaving the casted stones supported upright on the carrier plate 40 which carries the stones for curing as is well known in the art.

It is within the ambit of the present invention to cover any obvious modifications of the preferred embodiment described herein, provided such modifications fall within the scope of the appended claims.

The invention claimed is:

1. A concrete casted paving stone having opposed top and bottom surfaces and two pairs of opposed parallel side walls, a first of said pairs of side walls having a stone-engaging projection of predetermined shape formed in one of said side walls and spaced between said top and bottom surfaces and the other of said side walls having a slot shaped to receive therein at least a forward end portion of said stone-engaging projection of an adjacent one of said paving stones for interengagement therewith, a second of said pairs of opposed parallel side walls each having an elongated horizontal slot and a further stone-engaging projection horizontally aligned with said elongated horizontal slot wherein to engage with a further adjacent one of said paving stones with at least a forward end portion of said further stone engaging projection engaged in said elongated slot of said further adjacent one of said paving stone whereby a plurality of said paving stones can be interengaged to form a paved surface, said second of said pairs of opposed parallel side walls having like surfaces.

2. A concrete casted paving stone as claimed in claim 1 wherein said horizontal slot in said like surfaces of said second of said pairs of opposed parallel side walls extends from an open end at a common end of said like surfaces and terminate at an opposed predetermined end of said like surfaces.

3. A concrete casted paving stone as claimed in claim 2 wherein said further stone-engaging projection extends from said opposed end of said horizontal slot to said other of said side walls of said first of said pairs of side walls.

4. A concrete casted paving stone as claimed in claim 3 wherein said opposed predetermined end is disposed beyond mid-length of said like surfaces.

5. A concrete casted paving stone as claimed in claim 3 wherein a plurality of said paving stones are interengaged in opposed parallel horizontal and transverse rows or in an offset pattern to form said paved surface.

6. A concrete casted paving stone as claimed in claim 1 wherein said slot in said other of said side walls of said first of said pairs of side walls is a through slot which extends to said second of said pairs of opposed parallel side walls and through a rear wall of said further stone-engaging projection in said like surfaces.

7. A concrete casted paving stone as claimed in claim 1 wherein said further stone-engaging projection of each said like surfaces has a first portion thereof formed by opposed top and bottom projecting walls spaced from said top and bottom surfaces respectively and terminating at a flat ridge disposed parallel to said like side walls and a second portion of said further stone-engaging projection projecting from said flat ridge and shaped for close fit engagement in at least a portion of said elongated shaped horizontal slot of said further adjacent one of said paving stone.

8. A concrete casted paving stone as claimed in claim 5 wherein said opposed top and bottom projecting walls are inwardly sloping flat walls each terminating at a respective one of opposed straight parallel edges of said flat ridge.

9. A concrete casted paving stone as claimed in claim 8 wherein said second portion of said further stone-engaging projection is recessed from said opposed straight parallel edges of said flat ridge and is defined by inwardly sloping flat walls terminating in a flat end wall extending parallel to said like side walls.

10. A concrete casted paving stone as claimed in claim 7 wherein said elongated horizontal slot has a transverse cross-section shaped to receive said further stone-engaging projection in close fit therein.

11. A concrete casted paving stone as claimed in claim 10 wherein said stone-engaging projection of said first of said pairs of side walls is identically shaped as said further stone-engaging projection, said slot in the other of said side walls of said pairs of side walls having a transverse cross-section identical to said transverse cross-section of said elongated horizontal slot in said second of said pairs of opposed parallel side walls.

12. A concrete casted paving stone as claimed in claim 11 wherein said stone-engaging projection and said slot in said first of said pairs of side walls and said elongated horizontal slot and further stone-engaging projection of said like surfaces of said second of said pairs of opposed parallel side walls lie in a common plane between said top and bottom surfaces of said paving stone.

13. A concrete casted paving stone as claimed in claim 1 wherein said further stone engaging projection projects from said opposed parallel side walls a distance greater than the depth of said elongated horizontal slot whereby to form a space between said further one of said paving stone.

14. A concrete casted paving stone as claimed in claim 13 wherein said stone-engaging projection of said first of said pairs of side walls projects a distance greater than the depth in said slot of said other of said side walls to form a space between said adjacent one of said paving stone.

15. A concrete casted paving stone as claimed in claim 11 wherein said first portion of said stone-engaging projections in said first and second pairs of opposed parallel side walls constitute abutting spacing formations to create a space between said opposed two pairs of parallel side walls of adjacent paving stones.

16. A concrete casted paving stone as claimed in claim 15 wherein said paving stone is a permeable paving stone to form a permeable paved surface, and wherein said space between adjacent paving stones has uninterrupted void areas defining a void ratio to surface area of said stones of about 6%.

17. A concrete casted paving stone as claimed in claim 2 wherein said stone engaging projection in said one of said side walls of said first of said pairs of side walls has opposed sloped end faces extending inwardly towards one another from said one of said side walls to a free end thereof, said stone engaging projection in each said opposed parallel side walls of said second of said pairs of opposed parallel side walls having a sloped end face extending rearwardly from said opposed parallel side walls in a direction towards said other of said side walls of said first of said pairs of parallel side walls having said slot.

18. A concrete casted paving stone as claimed in claim 5 wherein said plurality of said paving stones in said opposed parallel horizontal rows are disposed in alternating opposed directions.

19. A concrete casted paving stone as claimed in claim 3 wherein said paving stone is casted upright in a mold disposed over a carrier plate with said further stone engaging projection disposed adjacent a bottom end of said mold wherein said mold can be stripped upwards with said paving stone resting on said carrier plate.

* * * * *